United States Patent [19]

Eheim

[11] Patent Number: 4,505,241

[45] Date of Patent: Mar. 19, 1985

[54] GOVERNOR FOR FUEL INJECTION PUMP

[75] Inventor: Franz Eheim, Stuttgart, Fed. Rep. of Germany

[73] Assignee: Robert Bosch GmbH, Stuttgart, Fed. Rep. of Germany

[21] Appl. No.: 559,655

[22] Filed: Dec. 9, 1983

[30] Foreign Application Priority Data

Jan. 18, 1983 [DE] Fed. Rep. of Germany ..... 3301416

[51] Int. Cl.[3] ..... F02D 1/04; F02D 17/06

[52] U.S. Cl. ..... 123/373; 123/449

[58] Field of Search ..... 123/373, 449, 364, 365

[56] References Cited

U.S. PATENT DOCUMENTS

| | | | |
|---|---|---|---|
| Re. 25,012 | 7/1961 | Dressler | 123/373 |
| 2,739,802 | 3/1956 | Pope | 123/373 |
| 2,865,347 | 12/1958 | Roosa | 123/373 |
| 3,014,475 | 12/1961 | Frick | 123/373 |
| 3,884,205 | 5/1975 | Staudt | 123/373 |
| 3,942,498 | 3/1976 | Eheim | 123/373 |
| 4,067,303 | 1/1978 | Aoki | 123/365 |
| 4,180,040 | 12/1979 | Hofer | 123/373 |
| 4,353,336 | 10/1982 | Mowbray | 123/365 |

*Primary Examiner*—Charles J. Myhre
*Assistant Examiner*—Carl Stuart Miller
*Attorney, Agent, or Firm*—Edwin E. Greigg

[57] ABSTRACT

A speed governor of a fuel injection pump for internal combustion engines is proposed, having a governor lever for adjusting the fuel injection quantity and a governor spring assembly engaging the governor lever counter to which assembly an rpm-dependent force acts. To compensate for manufacturing tolerances in the governor spring assembly, it is proposed that the effective length of a prestressed governor spring in the governor spring assembly be effected by means of the rotation of a spring plate, in that the spring plate has a sleeve provided with an outer thread, onto which part the governor spring can be threaded. After the rotation of the spring plate, this plate is held in its terminal position, under the influence of the initial stressing force of the governor spring, in a positively engaged connection with intermeshed components which limit the relieving of the governor spring assembly in the other direction.

7 Claims, 1 Drawing Figure

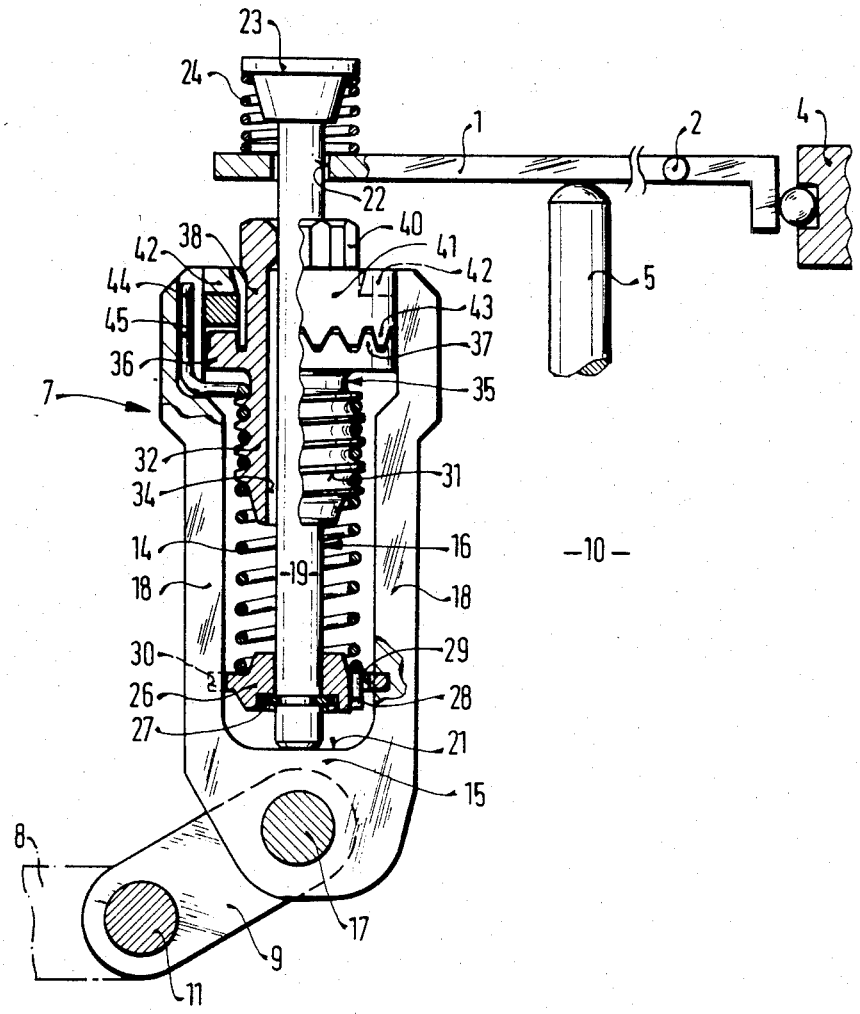
23
24
1
2
4
22
40
41
42
38
42
44
43
45
37
36
35
7
5
32
31
34
14
16
19
18
18
30
29
26
28
27
21
15
8
17
9
11

GOVERNOR FOR FUEL INJECTION PUMP

BACKGROUND OF THE INVENTION

The invention relates to a speed governor for a fuel injection pump for internal combustion engines. In a known speed governor of this kind (French laid-open patent application No. 20 54 116), a tension-loaded governor spring is provided which is coupled at one of its ends to a first support connected with an adjusting lever and at its other end to a second support connected with the governor lever. A part of one of the two supports protrudes coaxially into the center of the interior of the tensile spring and under the influence of the initial stress of the tension spring comes to rest on a part of the other support. The effective distance between the two support parts can be varied by means of a self-locking screw threaded into one of the two parts. In this manner, the initial stress of the spring is varied by varying the distance between the adjusting lever and the governor lever. A disadvantage of this arrangement, however, is that the outset position of the adjusting lever must be reset whenever the initial stress has to be adjusted to adapt it to the manufacturing tolerance of spring and connecting parts. In the known apparatus, an adjustment of the initial stress determines only the point of onset of speed regulation.

It has been found, however, that deviations in the degree of proportionality in mass production, that is the P-degree of the governor, occur because of manufacturing tolerances of the governor parts. Yet a very exact P-degree has to be adhered to particularly in the case of aggregate engines.

The degree of proportionality is the P-degree which indicates how high the rpm of a diesel engine during speed regulation increases from the rated rpm at full to the upper idling rpm. The P-degree is usually indicated in percent of the rpm increase up to the upper full-load rpm. The P degree has been set forth in the following publication:

*BOSCH,* "Technical Instruction, Fuel Injection Equipment for Diesel Engines (2) Governors for In-Line Pumps." Copyright Robert Bosch Gmbh (1975), Editor-in-Chief Ulrich Adler, Translation (1977) John T. Warner, Michael J. Scott, 1st edition September 1975, pages 8, 9, 13. A speed governor is also known from U.S. Pat. No. 3,942,498 granted Mar. 9, 1976. In this apparatus, the governor spring is embodied as a compression spring that is disposed coaxially with an actuation rod. The governor spring is supported on a spring plate on the actuation rod and on the side of this spring plate it is encompassed by a U-shaped bracket the ends of which are engaged by a further spring plate in a rotationally fixed manner with respect to a part of the U-shaped bracket; the further spring plate additionally acts as a guide means for the actuation rod. By means of the compression spring, the actuation rod is made to contact a part of the U-shaped bracket. With this apparatus, however, there is no way to compensate for manufacturing tolerances of the components of the governor spring assembly. Only the initial stress of the compression spring can be varied, by means of a spacer disc between the resting point of the one spring plate on the actuation rod and the spring plate.

OBJECT AND SUMMARY OF THE INVENTION

The speed governor according to the invention has the advantage over the above-described apparatus that in a simple manner, the effective length of the spring as well as its initial stress can be varied by threading a part of one of the supports into one of the spring ends. The P-degree of the governor, the steepness of speed regulation, is advantageously adapted to given requirements as a result of this provision. A further advantage is that no change takes place in the outset position of the adjusting lever or in the orientation of the supports to one another.

The preferred embodiment according to the drawing is particularly advantageous in that it has a stable form with respect to transverse forces and buckling, thereby preventing the governor spring assembly from swinging to and fro. The overall apparatus is quite compact and offers the further advantage that an adjustment device can be rotated in a simple manner, for instance through an opening in the wall of the injection pump, in order to adjust the initial stress of the spring.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows an exemplary embodiment of the invention, which is described in detail below.

DESCRIPTION OF THE PREFERRED EMBODIMENT

The drawing shows part of a distributor fuel injection pump of known design, as more fully disclosed in U.S. Pat. No. 3,942,498, having a governor lever 1, which is pivotable about a shaft 2 attached to the pump housing. It is adjustable as needed and is coupled with one lever arm to a quantity adjusting device 4, which may for instance be an annular slide displaceable on a pump piston of the distributor injection pump and by means of which annular slide a relief conduit of the pump work chamber is controlled. The other arm of the governor lever 1 is engaged by an adjusting sleeve 5 of an rpm transducer, not shown in detail here. Sleeve 5 exerts an rpm-dependent force upon the governor lever 1. A governor spring assembly 7 is coupled at one end to the end of the governor lever 1 and at its other end it is coupled by a lever arm 9 to an externally actuatable adjusting lever 8 on the fuel injection pump. The governor spring assembly 7, the rpm transducer and the quantity adjusting device 4 are located inside a fuel-filled suction chamber 10 of the fuel injection pump. The adjusting movement of the adjusting lever 8 is transmitted to the lever arm 9 by a shaft 11 that projects through the wall of the pump housing.

The governor spring assembly 7 substantially comprises a compression spring 14, which is fastened between a first support 15 and a second support 16. The first support 15 is connected via a pivot bolt 17 with the lever arm 9 and is embodied substantially as a U-shaped bracket or shackle having spaced parallel arms 18. The second support 16 comprises an actuation rod 19, which protrudes in parallel with the arms 18 from the open end of the bracket 15 into the recess formed by the bracket arms 18. This actuation rod 19 is located with its lower end, as viewed in the drawing, in the outset position on the bottom 21 of a U-shaped recess in the bracket arms 18 of the first support 16. The opposite or upper end of the actuation rod 19 projects through and is guided by a bore 22 in the governor lever 1. At the projecting outermost end, the rod 19 has a first spring plate 23, between which plate and the governor lever 1 an idling spring 24 is disposed. On the end of the rod 19 that protrudes into the U-shaped recess, a second spring plate 26 is disposed, the latter being secured by a fastening ring 27.

This second spring plate 26 acts as a support for one end of the compression spring 14, the lower wire end 28 of the spring being bent parallel to the axis of the actuation rod 19. The end 28 protrudes into a recess 29 of the second spring plate 26 in such a way that the spring plate 26 fixes the rotational position of the compression spring 14. To secure the spring plate 26 from twisting, by contrast, two diametrically opposed longitudinal grooves 30 are provided in the outer circumference of the spring plate 26. The bracket arms 18 protrude into these grooves 30 in order to guide the spring plate 26 and thus also the end toward this side of the actuation rod 19.

The other end of the compression spring 14 is threaded into a threaded path 31 of an outer thread cut on a barrel-like sleeve 32. This barrel-like sleeve 32 is part of a third spring plate 35 having an inner bore 34 receiving and guiding the actuation rod 19. Adjacent to the barrel-like sleeve 32, the third spring plate 35 has a collar 36, the end face of which remote from the compression spring 14 is formed as a spur gear 37. On the side of the radial serrations, the second spring plate 35 is contiguous with a cylindrical extension 38, which protrudes beyond the ends of the bracket arms 18 in the longitudinal direction. The extension 38 has coupling faces 40 on its outer jacket face which are suited for acting as an engagement point for a torsion tool and by way of which the second spring plate 35 can be rotated. For guiding the actuation rod 19, the diameter of the inner bore 34 is reduced in the vicinity of the coupling faces 40.

The spur gear 37 of the second spring plate 35 is engaged by a complementally formed shaped part 41, which is connected in at least a positively engaged manner with the ends of the bracket arms 18. The ends 42 of the bracket 18 themselves, which are bent inward toward the axis of the actuation rod 19, may serve as this shaped part, or else these bracket ends 42 hold a shaped part 41 embodied as a ring, which as a coupling element is provided with spur gear 43 meshing with the spur gear 37. The second spring plate 35 is now pressed by the initial stress of the compression spring 14 into the spur gear of the shaped part 41, so that the second spring plate 35 is fixed in a set rotational position relative to the first support part 15. One wire end 44 of the compression spring 14 on the side of the second support plate 35 protrudes into a recess 45 at one of the bracket ends 18, so that the compression spring 14 is secured against twisting at this end as well.

The mode of operation of the apparatus is as follows:

If the governor lever 1 is deflected by the adjusting sleeve 5 with increasing, rpm-dependent force, then first the idling spring 24 is compressed until the governor lever 1 comes to rest on the spring plate 23. With a further increase in the rpm-dependent force, the actuation rod 19 is now raised by the governor lever 1 from the bottom 21 of the first support part 15 held firmly by the lever 9, and the compression spring 14 is compressed. In this case, the speed regulation process is initiated, causing the quantity adjusting device 4 to be adjusted by the governor lever 1 in the direction toward reduced quantity. The characteristic of the compression spring 14 determines the course of regulation or the P-degree during regulation.

Because of the guidance of the first spring plate 26 and the guidance on the cylindrical extension 38 of the second spring plate 35, it is assured that in every relative position of the two supports with respect to one another the governor spring assembly 7 is sufficiently stable and sufficiently well secured against swinging to and fro.

In order to influence the P-degree, it is possible with the above-described apparatus for the compression spring 14 to be threaded to a greater or lesser distance onto the sleeve 32 by means of the rotation of the second spring plate 35, whereupon both the effective length and at the same time the initial stress of the compression are varied. By varying the effective length, in particular, the P-degree is influenced during speed regulation. Thus it is possible in a simple manner to compensate for manufacturing tolerances of the parts of the governor spring assembly.

In an advantageous manner the spur gear 37 is embodied such that the teeth form triangles, so that upon the rotation of the second spring plate an axial component is exerted upon the spring plate, and the teeth can be brought relatively easily out of the initial detent position into the next possible stable association relative to one another.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. In a speed governor of a fuel injection pump for internal combustion engines having a governor lever for adjusting the supply quantity and an rpm-dependent force applying means engaging the governor lever, a governor spring assembly interposed between the governor lever and an adjusting lever, said spring assembly having at least one spring that is pre-stressed between a first support means coupled to the adjusting lever and a second support means coupled to the governor lever, one of said support means being multi-parted, said first and second support means in an outset position being held in contact with one another by the force of said spring, and adjusting means for varying the initial stress of said one spring, said one spring being nonrotatably coupled at spaced locations thereon with one of said support means and at one end protruding into and engaging a thread on a first part of said multiple-part support means, said first part being rotatable about the axis of the thread relative to a second part of the multiple-part support means and being coupled under the influence of the force of the spring in a positively engaged manner with said second part.

2. A speed governor as defined by claim 1, in which the governor spring is embodied as a compression spring disposed coaxially with an actuation rod serving as said second support means, on which rod a first spring plate is seated for supporting the compression spring, said compression spring being encompassed from one side of said first spring plate by a U-shaped bracket means serving as said second part of said multi-part support means, said bracket means and first spring plate having coacting guide means providing for movement of the first spring plate on said bracket means, said bracket means having bracket arms having inwardly protruding shaped parts coacting as coupling members for a second spring plate comprising the first part of the multi-part support means, which second spring plate is guided on the actuation rod and on its end face adjacent to said shaped parts has the form of recesses complementary to said shaped parts.

3. A speed governor as defined by claim 2, in which for the purpose of its rotation said second part of the multi-part support means being provided with coupler faces for effecting a positively engaged connection with an adjusting tool.

4. A speed governor as defined by claim 2, in which said first spring plate has two diametrically opposed guide grooves, into which the bracket arms protrude, and a first end of the compression spring oriented toward said first spring plate is bent and protrudes into a recess on said first spring plate.

5. A speed governor as defined by claim 2, in which a second end of the compression spring oriented toward said second spring plate is threaded into a thread on a sleeve of said second spring plate, and a wire end of said second end of said compression spring is bent to protrude into and engage a recess on the first support.

6. A speed governor as defined by claim 4, in which a second end of the compression spring oriented toward said second spring plate is threaded into a thread on a sleeve of said second spring plate, and a wire end of said second end of said compression spring is bent to protrude into and engage a recess on the first support.

7. A speed governor as defined by claim 5, in which said recesses on said end face of second spring plate comprise a spur gear, with which under the influence of the compression spring the inwardly protruding shaped part on said bracket means mesh, and said second spring plate has a cylindrical extension coaxially protruding out on the side of the spur gear, which cylindrical extension has at least one coupler face on its jacket face protruding beyond said bracket arms.

* * * * *